United States Patent [19]

Tani

[11] 3,983,813

[45] Oct. 5, 1976

[54] DEVICE FOR CLEANING BLANKET CYLINDER OF PRINTING PRESS

[75] Inventor: Kenji Tani, Fuchu, Japan

[73] Assignee: Dai Nippon Insatsu Kabushiki Kaisha, Tokyo, Japan

[22] Filed: June 5, 1975

[21] Appl. No.: 584,157

[30] Foreign Application Priority Data

June 11, 1974 Japan ..... 49-66303

[52] U.S. Cl. ..... 101/425; 15/57

[51] Int. Cl.[2] ..... B41F 35/06; B41L 41/06

[58] Field of Search ..... 101/425; 15/256.5, 256.51, 15/256.52, 256.53, 57, 88, 104.04

[56] References Cited

UNITED STATES PATENTS

| | | | |
|---|---|---|---|
| 2,064,577 | 12/1936 | Thayer | 15/88 |
| 2,195,202 | 3/1940 | Connal | 15/57 |
| 2,393,992 | 2/1946 | Kauffeld | 101/425 |
| 2,525,982 | 10/1950 | Wescott | 101/425 |
| 2,551,601 | 5/1951 | Hughson | 101/425 |
| 2,704,029 | 3/1955 | George | 101/425 |
| 2,705,455 | 4/1955 | Buttner | 101/425 |
| 3,050,759 | 8/1962 | Betzel, Sr. | 15/104.04 |
| 3,120,805 | 2/1964 | Simon | 101/425 |
| 3,252,416 | 5/1966 | Allen | 101/425 |
| 3,309,993 | 3/1967 | Grembecki et al. | 101/425 |
| 3,411,444 | 11/1968 | Boneschi | 101/425 |
| 3,422,758 | 1/1969 | Brewster | 101/425 |
| 3,559,570 | 2/1971 | Martel | 101/425 X |
| 3,656,200 | 4/1972 | Riley | 101/425 |
| 3,737,940 | 6/1973 | Maestue | 101/425 X |
| 2,889,566 | 6/1959 | Parks | 15/57 X |

*Primary Examiner*—Edgar S. Burr
*Assistant Examiner*—Paul J. Hirsch
*Attorney, Agent, or Firm*—Spensley, Horn & Lubitz

[57] ABSTRACT

In a cleaning device for a blanket cylinder in an offset lithographic printing press, there are provided a power-rotated cleaning disc having a front surface partly in contact with the cylindrical surface of the blanket cylinder, a tank associated with the cleaning disc for storing and supplying a predetermined quantity of a cleaning liquid to the cleaning disc, and a lateral feed mechanism for driving the cleaning disc in reciprocating motion transversely along the cylindrical surface of the blanket cylinder, whereby the latter surface is cleaned while the blanket cylinder is rotated at a low speed.

10 Claims, 7 Drawing Figures

DEVICE FOR CLEANING BLANKET CYLINDER OF PRINTING PRESS

BACKGROUND OF THE INVENTION

This invention relates generally to offset lithographic machines, and more particularly to a device for cleaning a blanket cylinder in an offset lithographic press and the like.

In the offset lithographic press (or offset printing press) widely used in recent years, there are ordinarily provided three cylinders, namely, a plate cylinder on which a metal printing plate is clamped, a blanket cylinder wrapped with a rubber blanket, and an impression cylinder urging a sheet stock to be printed against the blanket cylinder. Ink is supplied from an ink supplying device, and extended over the printing plate so that the ink is deposited on the printing part of the printing plate owing to, for instance, affinity of that part to the ink. Simultaneously therewith, water is supplied to dampen the nonprinting plate.

In the course of the rotations of the three cylinders, a major part of the ink deposited on the printing part of the printing plate is transferred from the surface of the plate cylinder to the corresponding part of the blanket cylinder and then transferred (offset) therefrom to the surface of the sheet stock, such as paper, which is fed through a paper guide plate provided in the neighborhood of the impression cylinder, and caught by teeth provided around the lateral ends of the impression cylinder.

In an offset lithographic press of the above described character, wherein the ink deposited on the plate cylinder is once transferred onto the blanket cylinder and then retransferred onto the paper pressed against the blanket cylinder by the impression cylinder, it is essential that any dirt or dust, inclusive of deposition of ink, collected on the surface of the blanket cylinder be cleaned off thoroughly.

Heretofore, such a cleaning operation has been carried out by hand while the cylinders are rotated at low speeds, by pressing, for instance, a piece of cloth impregnated with a cleaning liquid against the surface of the blanket cylinder. Such an operation, however, is not only a labor consuming work, but also is extremely dangerous because of the possibility of the operator's hand being caught between the rotating cylinders.

In order to overcome the above mentioned disadvantages of the manual method of cleaning the blanket cylinder, there has been proposed an automatic cleaning device for the blanket cylinder, which comprises an endless belt extended around a driving wheel and a dummy wheel so that the endless belt is driven in a direction parallel to the rotating axis of the blanket cylinder, a layer of sponge secured onto the outer surface of the endless belt in a manner such that the layer can be brought into contact with the outer surface of the blanket cylinder when the driving wheel and the dummy wheel are both shifted toward the blanket cylinder, a squeeze roller forced onto the sponge layer on the outer span of the endless belt, and a nozzle provided at an upstream position relative to the squeeze roller for supplying a cleaning liquid onto the sponge layer on the endless belt.

With the automatic cleaning device of the above described construction, the outer surface of the blanket cylinder is cleaned, while it is rotated at a low speed, by the sponge layer on the endless belt impregnated with the cleaning liquid, and the used dirty liquid is squeezed out of the sponge layer by the squeeze roller during the travel of the endless belt.

However, the automatic cleaning device of the above described construction inevitably becomes of a greater size, and consumes a comparatively greater quantity of cleaning liquid. Furthermore, the device cannot remove any oxide layer which might be created on the outer surface of the blanket cylinder, and the working life of the endless belt also has been relatively short.

SUMMARY OF THE INVENTION

With the above described difficulties of the conventional cleaning device in view, a primary object of the present invention is to provide a cleaning device for the blanket cylinder in an offset lithographic printing press which is simple in construction and economical in manufacture.

Another object of the invention is to provide a cleaning device for the blanket cylinder in an offset lithographic printing press, whose operational life is far longer than that of the conventional cleaning device.

Still another object of the invention is to provide a cleaning device for the blanket cylinder in an offset lithographic printing press, whereby the blanket cylinder can be thoroughly cleaned in a comparatively short time with minimal consumption of the cleaning liquid.

A cleaning device for the blanket cylinder according to the present invention comprises a cleaning disc having a front surface partly contacting the cylindrical surface of the blanket cylinder and power-driven around its axis, means for supplying a cleaning liquid to the cleaning disc, and means for transversely displacing the power-driven cleaning disc and said supplying means along the cylindrical surface of the blanket cylinder while the cylinder is rotated at a slow speed.

The invention will be more clearly understood from the following detailed description of the invention when read in conjunction with the accompanying drawings, wherein like parts are designated by like reference numerals.

Figure 1:
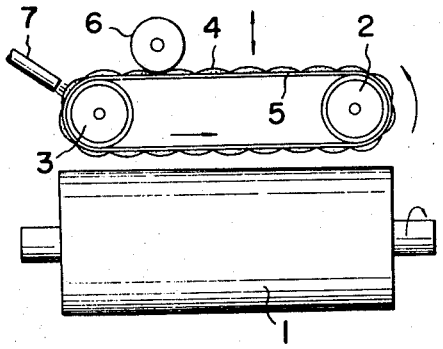
FIG. 1 PRIOR ART
FIG. 1 is an elevational view in a direction perpendicular to the axis of a blanket cylinder showing an example of a conventional cleaning device for the blanket cylinder.

For a better understanding of the present invention, a conventional cleaning device for the blanket cylinder will now be described briefly with reference to FIG. 1. This known device comprises: a driving roller 2; an idler roller 3; an endless belt 5 extended around, whereby the belt 5 can be driven in a direction parallel to the rotational axis of a blanket cylinder 1 of an offset lithographic printing press; a sponge layer 4 secured onto the outer surface of the endless belt 5; a squeeze roller 6 adapted to be forced against the sponge layer 4 on the outer span of the endless belt 5; and a nozzle 7 for supplying a cleaning liquid onto the sponge layer 4, provided at an upstream position of the inner span of the endless belt 5.

In operation, the entire cleaning device is displaced toward the blanket cylinder 1 until the part of the sponge layer 4 on the inner span of the belt 5 is brought into contact with the blanket cylinder 1. Thus, with the belt 5 being driven in the arrow direction, and the cylinder 1 being rotated at a lower speed, the outer surface of the blanket cylinder can be cleaned by the sponge layer 4 of the endless belt 5 impregnated with the cleaning liquid and moving along the surface of the blanket cylinder 1 in parallel to the axis thereof. The cleaning liquid contained in part of the sponge layer 4 which has already passed along the blanket cylinder 1 and hence is contaminated is squeezed out of the sponge layer by the squeeze roller 6.

Although the known cleaning device of the above described construction has proved to be advantageous in effecting economy in labor cost for cleaning the blanket cylinder, the size of the cleaning device is found to become considerably large, and the consumption of the cleaning liquid is much greater than that required for the manual cleaning operation.

These disadvantages of the conventional cleaning device can be overcome by a blanket cleaning device according to the present invention which will be described with reference to FIGS. 2 through 4.

In the illustrated example, a cleaning disc 8 and a rotatable backing body 12 are secured in combination onto a rotating shaft 10 of an electric motor 9 by means of, for instance, a nut 11. The cleaning disc 8 has a front surface 8*a* which may be a planar surface or any curved surface. The cleaning disc 8 may be made of any of various materials such as rubber, synthetic resin, and metal depending on the nature of the dirt to be cleaned off the blanket cylinder. An upper forward part of the front surface 8*a* of the cleaning disc 8 is caused to abut against the blanket cylinder 1 at a position slightly upward from a horizontal plane passing through the rotational axis of the blanket cylinder 1, and the rotational axis of the cleaning disc 8 and the rotatable backing body 12 is disposed at right angles to a plane containing the rotational axis of the blanket cylinder 1 but not intersecting said rotational axis of said blanket cylinder.

The above mentioned cleaning disc 8 is partly housed within a front compartment 16 of a main structure 15 of the cleaning device of the invention, in which main structure 15 there is formed a cleaning liquid tank 14 for storing a quantity of a cleaning liquid 13 sufficient for one cycle of cleaning operation. Furthermore, the front upper half of this cleaning disc 8 projects and is exposed outward through a cutout opening 17 in the front upper part of the front compartment 16.

The cleaning liquid 13 in the tank 14 is pumped up by means of, for instance, a pumping device (not shown) operating simultaneously with the start of rotation of the cleaning disc 8, and delivered onto the front surface of the cleaning disc 8 through an inner passage (not shown) provided in the shaft 10 or a hose (also not shown) provided separately outside of the shaft 10.

Figure 2:
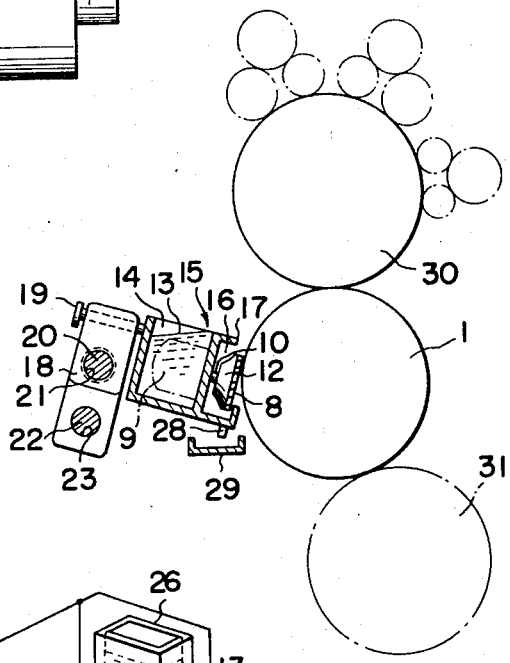
FIG. 2 is a side view, in vertical section, showing an example of a cleaning device according to the present invention.
Figure 3:
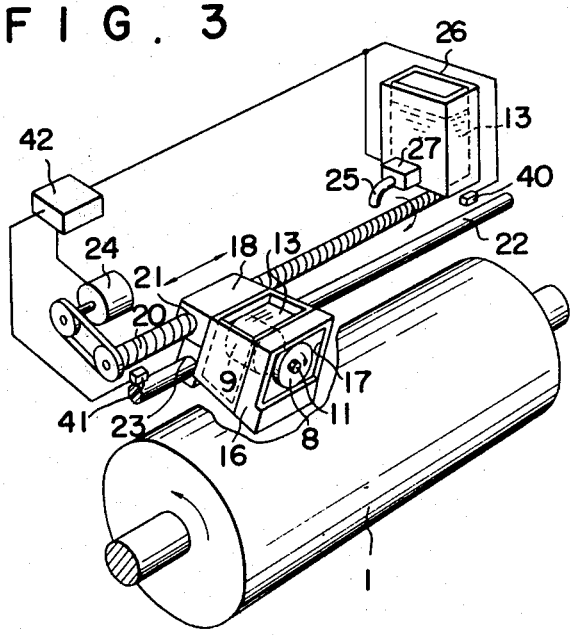
FIG. 3 is a perspective view of the example shown in FIG. 2.
Figure 4:
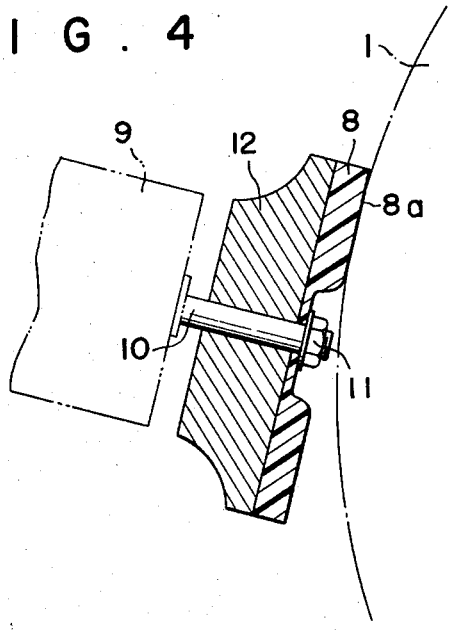
FIG. 4 is an enlarged side view, in vertical section, showing a part of the device shown in FIG. 2.

The main structure 15 of the cleaning device is mounted on a front part of a transverse-shifting carriage 18 of a transverse-shifting mechanism as clearly indicated in FIGS. 2 and 3, which carriage 18 is thread-engaged with a fine adjustment screw 19 for adjusting the position of the main structure 15 precisely in the forward-and-backward direction (perpendicular to the rotational axis of the blanket cylinder 1).

An internally threaded hole 21 and a through hole 23 are provided transversely through the transverse-shifting carriage 18, and a screw-threaded shaft 20 is engaged with the internally threaded hole 21 so that when the shaft 20 is rotated in either direction by means of, for instance, a reversible motor 24, the transverse-shifting carriage 18 and the main structure 15 of the cleaning device are displaced rightwardly or leftwardly relative to the blanket cylinder 1 under the guidance of a guide bar 22 slidably passing through the through hole 23.

After one cycle of forward and return transverse travel of the carriage 18 and the main structure 15 as a result of one cycle of operation of the transverse-shifting mechanism comprising the carriage 18, the screw-threaded shaft 20, the guide bar 22, and driving means of the screw-threaded shaft 20, the main structure 15 of the cleaning device is brought back into a fixed return station transversely outside of one end of the blanket cylinder 1. A cleaning liquid reservoir 26 having at its lower part a delivery port 25, opened and closed by an electromagnetic valve 27 is provided immediately above this fixed return station and contains a considerable quantity of the cleaning liquid 13.

Each time the main structure 15 of the cleaning device is brought into the fixed return station, the cleaning liquid 13 of a quantity sufficient for use in the subsequent cycle of the cleaning operation is delivered from the reservoir 26 into the tank 14 of the cleaning device main structure 15 through the delivery port 25 of the reservoir 26 under the control of the electromagnetic valve 27, which is operated by a detecting device 40. The entire cleaning operation of this example, from the start to the ultimate reception of the cleaning liquid, is carried out under the control of a combination of timers (not shown) and another detecting device 41.

Furthermore, a drain port 28 is provided at the lowermost position of the front compartment 16, and a part of the used cleaning liquid is discharged through this drain port 28 to be received in a tray 29 suitably secured to the structure 15 below the drain port 28. The tray 29 may take the form of an elongated stationary tray which is not secured to the compartment 16 and is provided along the length of the cylinder 1. Another part of the used cleaning liquid passing over the surface of the blanket cylinder 1 is received in another receiving tray (not shown). As is apparent in FIG. 2, the blanket cylinder 1 is rotated in contact with a plate cylinder 30 disposed thereabove and an impression cylinder 31 disposed therebelow as well known in the art.

The operation of the cleaning device will now be described. The main structure 15 is initially at the fixed return station laterally outside of one end of the blanket cylinder 1, at which position a quantity of the cleaning liquid sufficient for one reciprocating stroke or cycle of the cleaning operation is delivered from the cleaning liquid reservoir 26 into the tank 14 of the main body 15.

When it is required to clean the blanket cylinder 1, the cleaning operation of the aforementioned cleaning device is initiated by, for instance, pushing a push-button switch (not shown). Upon depression of the push-button switch, the blanket cylinder 1 is rotated at a slow speed, and motors 9 and 24 are driven thereby to rotate the screw-threaded shaft 20 in the forward direction and also to rotate the cleaning disc 8 around its rotational axis. Since the rotation of the screw-threaded shaft 20 causes the main structure 15 of the cleaning device to be displaced along the surface of the blanket cylinder 1, the surface of the blanket cylinder 1, which is rotated at a slow speed, is cleaned in a helical band-like configuration by the rotating cleaning disc 8.

At an instant when the main structure travelling in the forward direction reaches the other extremity of its path, a detector 41 detecting this fact delivers an output signal, to a control device 42 whereby the electric motor 24 is reversed in its rotating direction. Thus, the screw-threaded shaft 20 is rotated in the reverse direction, and the main structure 15 of the cleaning device is retracted to the first mentioned fixed return station (hereinafter called the retracted position). During the return pass of the main structure 15, the surface of the blanket cylinder 1 is further cleaned by the rotating cleaning disc 8 along another helical band-like path.

Figure 5:
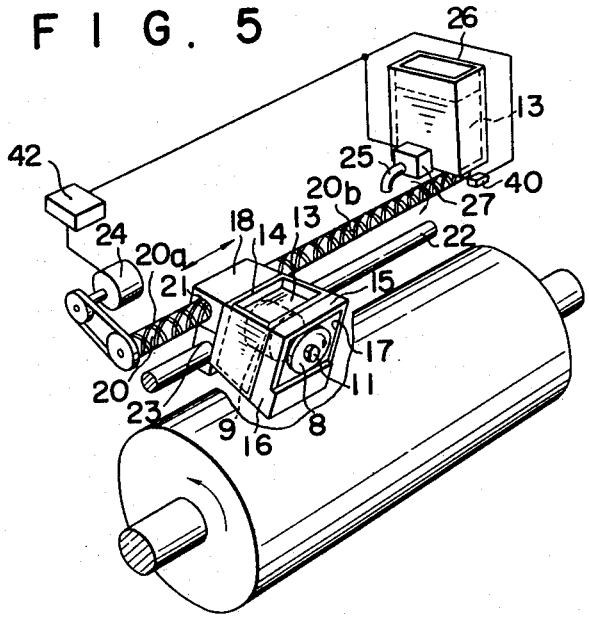
FIG. 5 is a view similar to FIG. 3, but showing a modification of the cleaning device.

Alternatively, the above-mentioned reciprocating movement of the main struction 15 may also be attained by modifying the screw-threaded shaft 20, as shown in FIG. 5, into a cylindrical cam having right hand and left hand helical grooves 20*a* and 20*b*, and providing a cam follower in the form of a projection projecting from the main structure 15 and engaging the groove 20*a* or 20*b*. In this manner, the the reciprocating movement of the main structure 15 can be realized without reversing the rotation of the shaft 20 modified into the cylindrical cam. That is, when the projection of the main structure 15 constituting the above mentioned cam follower is shifted to an extremity along the forwarding cam groove 20*a*, the projection is shifted into the return groove 20*b*, and the projection and hence the main structure will now be shifted to the other extremity of the return groove. At the extremity of this groove, the projection is again transferred into the forwarding groove.

In either of the above described cases, the cleaning liquid in the tank 14 has been used almost completely when the main structure 15 of the cleaning device is brought back to the retracted position transversely outside of one end of the blanket cylinder 1. The electromagnetic valve 27 provided at the delivery port 25 of the reservoir 26 is then operated by the detecting device 40, and a quantity of the cleaning liquid sufficient for the subsequent one cycle of the cleaning operation is supplied from the reservoir 26 to the tank 14 in the main structure 15.

Figure 6:
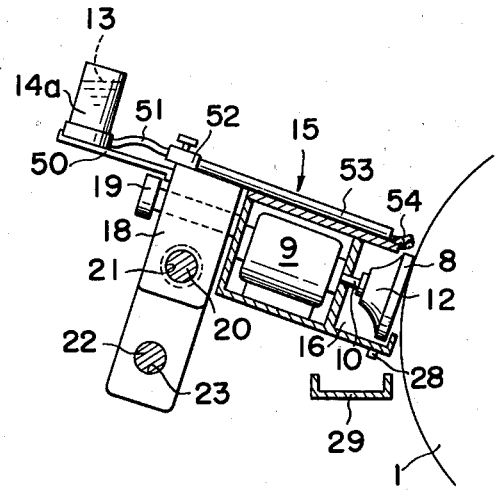
FIG. 6 is a view similar to FIG. 3, but showing a further modification of the cleaning device.
Figure 7:
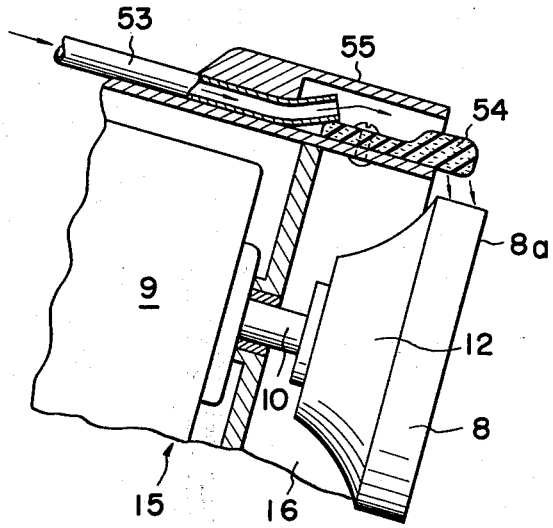
FIG. 7 is a fragmentary view, on an enlarged scale, showing part of FIG. 6.

In a modified form of the invention illustrated in FIGS. 6 and 7, a cleaning liquid tank 14*a* is not provided in the main structure 15 but provided outside the same and the cleaning liquid 13 in the tank 14*a* is supplied to the cleaning disc 8 gravitationally without using a pump. More specifically, the carriage 18 has attached thereto a bracket 50 on which the liquid tank 14*a* is mounted. The liquid 13 in the tank 14*a* is supplied to the cleaning disc 8 through a hose 51, a cock 52 and a pipe 53. The cock 52 and the pipe 53 are secured to the main structure and the downstream end of the pipe 53 opens directly above the cleaning disc 8.

As shown in FIG. 7, a cleaning liquid absorbing piece 54 is preferably secured to the main structure 15 adjacent the downstream end of the pipe 53. The piece 54 is made, for example, of a porous material such as rubber sponge. In order to direct the cleaning liquid flowing out of the pipe 53 to the disc 8, a cover 55 may be secured to the main structure. It will be readily understood that when the cock 52 is opened the cleaning liquid 13 is allowed to flow down the pipe 53 gravitationally and is supplied to the disc 8. In this case, the porous piece 54 serves to retain some amount of the liquid therein and to prevent the liquid from being scattered, so that all the liquid supplied is used effectively to clean the surface of the blanket cylinder 1.

Since the cleaning action of the cleaning device according to the present invention for cleaning the surface of the blanket cylinder is a rubbing action similar to that in the case of a buffing wheel, not only dirt and dust such as ink waste and paper dust, but also any oxide film formed on the blanket cylinder can be removed effectively. Furthermore, since only a predetermined quantity of the cleaning liquid is consumed for each cycle of the cleaning operation, any wasteful deliver of the cleaning liquid as in the case of the conventional blanket cleaning device can be prevented. Additionally, the cleaning device of the present invention is of a relatively small size, simple in construction, and economical in manufacture and operation and is readily installed.

I claim:

1. A device for cleaning a rotary blanket cylinder having an axis of rotation in an offset lithographic press, comprising:

a power rotated cleaning disc having a front surface partly in contact with a cylindrical surface of said blanket cylinder, said power rotated cleaning disc rotating about an axis which is located on a line that passes through said cylinder, close to, but does not intersect with said axis of rotation of said blanket cylinder;

a means for storing and supplying cleaning liquid to said cleaning disc; and a lateral feed mechanism for moving said cleaning disc and said storing and supplying means traversely along the surface of said blanket cylinder and parallel to the axis of rotation of said blanket cylinder whereby the cylindrical surface of said blanket cylinder is automatically cleaned while said cleaning disc and said blanket cylinder are rotated about their respective axes.

2. A cleaning device as set forth in claim 1 wherein said cleaning disc is rotatably supported by said storing and supplying means.

3. A cleaning device as set forth in claim 2 wherein a cleaning reservoir is further provided at one end of said traverse movement, and a means for supplying a predetermined quantity of cleaning liquid from said reservoir to said storing and supplying means each time said storing and supplying means is traversed to said end.

4. A cleaning device as set forth in claim 3 wherein said lateral feed mechanism comprises a screw-threaded shaft for supporting said storing and supplying means in thread engagement therewith, a guide bar parallel with said screw-threaded shaft and slidably engaged with said storing and supplying means for slidably guiding said storing and supplying means along the cylindrical surface of the blanket cylinder, and means for rotating said screw-threaded shaft in forward and reverse rotating directions.

5. A cleaning device as set forth in claim 3 wherein said lateral feed mechanism comprises a return-grooved cylindrical cam, a follower of said cylindrical cam provided in the form of a projection from said storing and supplying, and means for rotating said cylindrical cam in a single rotating direction.

6. A cleaning device as set forth in claim 2 wherein a recessed compartment is provided in said storing and supplying for encasing a major part of said cleaning disc for guarding said cleaning disc and collecting a part of the cleaning liquid which has been used in the cleaning operation.

7. A cleaning device as set forth in claim 1 wherein said cleaning disc is rotatably supported by a structure which supports said storing and supplying means.

8. A cleaning device as set forth in claim 7 wherein said storing and supplying means comprises a cleaning liquid tank mounted on said structure, conduit means secured to said structure for conducting said cleaning liquid from said tank to said cleaning disc to supply said cleaning liquid from above said disc.

9. A cleaning device as set forth in claim 8, further including a porous piece mounted above in a spaced apart relation to said cleaning disc and receiving the cleaning liquid from said conduit means.

10. A cleaning device as set forth in claim 6 wherein a portion of said recessed compartment for encasing a major portion of said cleaning disc extends between said cleaning disc and said blanket cylinder.

* * * * *